US005979173A

United States Patent [19]

Tyree

[11] Patent Number: 5,979,173

[45] Date of Patent: Nov. 9, 1999

[54] DRY ICE RAIL CAR COOLING SYSTEM

[76] Inventor: Lewis Tyree, 115 Liberty Hall Rd., Lexington, Va. 24450

[21] Appl. No.: 08/924,410

[22] Filed: Aug. 22, 1997

Related U.S. Application Data

[63] Continuation-in-part of application No. 08/688,413, Jul. 30, 1996, Pat. No. 5,660,057

[60] Provisional application No. 60/030,057, Nov. 6, 1996.

[51] Int. Cl.[6] ..... F25D 3/12

[52] U.S. Cl. ..... 62/388; 62/385

[58] Field of Search ..... 62/384, 385, 388

[56] References Cited

U.S. PATENT DOCUMENTS

| | | | |
|---|---|---|---|
| 1,873,131 | 8/1932 | Josephson | 62/388 X |
| 1,980,089 | 11/1934 | Rice, Jr. | 62/388 X |
| 2,313,120 | 3/1943 | Bonsall | 62/388 X |
| 2,550,935 | 5/1951 | Pike | 62/384 X |
| 4,206,616 | 6/1980 | Frank et al. | 62/384 X |
| 4,299,429 | 11/1981 | Franklin, Jr. | 62/384 X |
| 4,498,306 | 2/1985 | Tyree, Jr. | 62/384 X |
| 4,502,293 | 3/1985 | Franklin, Jr. | 62/388 |
| 4,593,536 | 6/1986 | Fink et al. | 62/239 |
| 4,704,876 | 11/1987 | Hill | 62/388 |
| 4,761,969 | 8/1988 | Moe | 62/388 |
| 4,891,954 | 1/1990 | Thomsen | 62/388 X |
| 5,074,126 | 12/1991 | Mahieu | 62/388 |
| 5,152,155 | 10/1992 | Shea et al. | 62/388 X |
| 5,168,717 | 12/1992 | Mowatt-Larssen | 62/239 |
| 5,323,622 | 6/1994 | Weiner et al. | 62/239 |
| 5,397,010 | 3/1995 | Gibot | 220/1.5 |
| 5,415,009 | 5/1995 | Weiner et al. | 62/239 |
| 5,423,193 | 6/1995 | Claterbos et al. | 62/384 |
| 5,460,013 | 10/1995 | Thomsen | 62/239 |
| 5,555,733 | 9/1996 | Claterbos et al. | 62/62 |

FOREIGN PATENT DOCUMENTS 399678 12/1932 United Kingdom .

OTHER PUBLICATIONS

E.L. Quinn and C.L. Jones "Carbon Dioxide" Amer. Chem. Soc. Reinhold Pub. 1936, Chap. VII, pp. 230–240.

*Primary Examiner*—Christopher Kilner

[57] ABSTRACT

The cargo area of a refrigerated railroad car is cooled by convectors positioned along the upper side and walls of the cargo side and end walls of the cargo compartment of the car. The convectors are cooled by a supply of carbon dioxide snow in a bunker above the cargo compartment. Alternately, vents between the bunker and the cargo compartment and along the upper side and end walls of the cargo compartment enhance and direct carbon dioxide vapor circulation between the cargo area and the bunker. The convectors and the vents can be used independently or in combination.

32 Claims, 7 Drawing Sheets

DRY ICE RAIL CAR COOLING SYSTEM

CROSS REFERENCE TO RELATED APPLICATIONS

This application is a continuation-in-part of application Ser. No. 08/688,413, filed Jul. 30, 1996, U.S. Pat. No. 5,660,057 of Lewis Tyree, Jr. Priority for the present invention is based upon prior filed Provisional patent application Ser. No. 60/030057 of Lewis Tyree, Jr. entitled DRY ICE RAIL CAR COOLING SYSTEM filed on Nov. 6, 1996, Document Disclosure 394220 filed Mar. 14, 1996 and 407160 filed Oct. 25, 1996.

BACKGROUND—FIELD OF INVENTION

This invention relates to an on-board solid carbon dioxide or dry ice refrigeration system for rail (railroad) cars and more particularly to the construction and methods of use of the dry ice bunker, the freight storage compartment and the divider between the two when utilizing carbon dioxide as an expendable refrigerant in transporting products by railroad cars but also useful for other substantially sized vehicles such as trucks, trailers, shipping containers and the like being moved over substantial distances or in circumstances where enroute cold temperature protection is essential, and in an arrangement where no mechanical refrigeration device is included, principally using, as appropriate to each specific case, bunker construction and placement, bunker filling method, bunker vent size and inlet ducting, as well as convectors (and location of each), natural phenomena, cargo area construction and insulation choice and techniques to maintain the cargo in the refrigerated state, and especially useful to food cargo in the frozen state.

BACKGROUND—DESCRIPTION OF BACKGROUND ART

A number of systems utilizing the refrigeration potential of both dry ice blocks or dry ice snow (both a form of solid carbon dioxide), and gaseous carbon dioxide, resulting either from the depressurization or flashing of liquid carbon dioxide, or from sublimation of the already formed dry ice for cooling in transit containers or vehicles, have been proposed heretofore and many are described in Chap. VIII of "Carbon Dioxide", a monograph of The American Chemical Society by E. L. Quinn and C. L. Jones, published in 1936 by Reinhold Publishing Company, New York, N.Y. Examples of such early basic systems were those proposed in Martin U.S. Pat. No. 1,752,277 issued Mar. 25, 1930; in Kurth U.K. Pat. No. 399,678 accepted Oct. 12, 1933; in Thoke U.S. Pat. No. 1,935,923 issued Nov. 21, 1933; and more recently in Rubin U.S. Pat. No. 3,561,266 issued Feb. 9, 1971; in Frank U.S. Pat. No. 3,864,936 issued Feb. 11, 1975; in Franklin U.S. Pat. No. 4,299,429 issued Nov. 10, 1981 and in Gibot U.S. Pat. No. 5,397,010 issued Mar. 14, 1995. In the Rubin '266 Patent, carbon dioxide liquid was flashed within a metal container located at the top of the vehicle storage area so as to form dry ice snow within the container. The lower surface of the container became cold enough to cool the interior of the vehicle storage area and also the resultant carbon dioxide vapor escaped via one or more vents (located in the sides, each opposite a liquid carbon dioxide injection nozzle) from the container optionally into the storage area so as to aid in cooling. All such systems, where the refrigerant is used up in providing the cooling effect are referred to as expendable systems and the refrigerant as an expendable refrigerant. If no fans or blowers are provided, the systems are referred to as "passive systems", as opposed to those with fans or blowers which are referred to as "active systems." If in addition to no fans, there are no mechanical devices of any kind, it is also referred to as a "no moving part system" or totally passive system.

Rather than attempt to generally cool the cargo volume as in Rubin and the others, more recent practice for transporting refrigerated foods, whether the cooling is from an expendable refrigerant or the result of a mechanical system, where a densely packed, heavy cargo occurs, and thus where carbon dioxide vapor or cold air can not readily circulate through the cargo itself, is to arrange for circulation around the periphery of the cargo, and thus protection is provided by intercepting the heat from the outside before it can warm the cargo. Mechanical refrigeration type in transit refrigeration devices typically provide very active circulation by the use of blowers to circulate cold air so as to encircle all cargo outer surfaces. This of course requires fans, vehicle interior construction and cargo loading methods so as to achieve adequate and properly directed air circulation. One such method of cooling railcars is disclosed in Black U.S. Pat. No. 2,923,384 issued Feb. 2, 1960 in a floor, top and sides through which mechanically refrigerated air may be circulated. Thousands of mechanical refrigeration railcars were once used in the U.S., but today the advent of fast, through freight trains have made their enroute repair needs into a major drawback.

A number of patents disclose passive periphery gaseous circulation around the cargo caused by solid carbon dioxide, i.e.: in Bonine U.S. Pat. No. 1,880,735 issued Oct. 4, 1932; in the Martin and Kurth patents previously identified; in Zeidler U.S. Pat. No. 2,321,539 issued Jun. 8, 1943; in Hall U.S. Pat. No. 2,508,385 issued May 23, 1950; in Lindersmith U.S. Pat. No. 3,206,946 issued Sept. 21, 1965; and more recently in Franklin U.S. Pat. No. 4,299,429 issued Nov. 10, 1981. Franklin U.S. Pat. No. 4,502,293 issued Mar. 5, 1985 is an example of a carbon dioxide system for containers wherein a temperature responsive damper valve controls the circulation and thus the temperature of the container, i.e. either fresh (non-frozen) or frozen temperature. However when totally passive (no moving parts) techniques were applied to containers as large as railroad cars using expendable refrigerants (as in Fink, et al U.S. Pat. No. 4,593,536 issued Jun. 10, 1986), the density differences and the vapor circulation methods utilized produced proved insufficient to cause effective peripheral circulation. A different approach is disclosed in Mahieu U.S. Pat. No. 5,074,126 issued Dec. 24, 1991 wherein the very cold temperature of solid carbon dioxide is used to create high density differences within a small refrigerated chamber sufficient to create ducted jets of cold vapor essentially cooling the entire chamber.

In an earlier attempt to maintain all the cargo (including that adjacent to the floor), in a uniform frozen state, a railroad car was built with lengthwise storage tubes, carrying liquid carbon dioxide stored at approximately 0° F. under 300 psig pressure, as part of the flooring system. These tubes both prevented heat incursion through the floor and supplied liquid carbon dioxide for injection above the cargo in response to a thermostat. However, the complexity, the extra weight and cost of pressure tubes when compared to an open bunker was not attractive, and only one car is known to have been so constructed.

Certain European shippers pre-sub cooled their cargo well below the normal frozen food temperature in an attempt to have their food cargo itself provide the needed refrigeration by becoming thermal ballast; but isolated spots of excessively warm cargo resulted, as heat transfer within the cargo mass is usually too slow to provide the refrigeration to the points of heat incursion when needed in cargos as large as those of rail cars.

Other patents disclosing dry ice concepts suitable for rail cars, trailers or similarly sized shipping containers include: U.S. Pat. No. 4,761,969 to Moe; U.S. Pat. No. 4,891,954 to Thomson; U.S. Pat. No. 4,951,479 to Araquistain et al; U.S. Pat. No. 5,152,155 to Shea et al; U.S. Pat. No. 5,168,717 to Mowatt-Larssen, which describes a floor with convoluted passageways in an attempt to improve the floor pre-sub cooling and cooling; U.S. Pat. 5,323,622 to Weiner et al; U.S. Pat. No. 5,415,009 to Weiner et al, which describes a car with insulation directly under the cargo and between the exiting bunker flash gas, so as to cool the floor but not freeze the cargo for non-frozen cargo applications; U.S. Pat. Nos. 5,423,193 and 5,555,733 to Claterbos et al, which describes a heavily insulated bunker floor so as to provide lengthened in transit times and U.S. Pat No. 5,460,013 to Thomsen which describes a special liquid carbon dioxide bunker charging system designed to prevent over-pressure there.

Hill U.S. Pat. No. 4,704,876 issued Nov. 10, 1987 represents the most successful bunker type carbon dioxide rail car cooling system in use in the U.S. and one that has found wide use in transcontinental service. The entire system was designed primarily for frozen foods, say in the range of −20° F. to +20° F., but commonly referred to as a 0° F. system and was designed specially for larger cargo volumes and longer trips, where carbon dioxide snow is deposited within a large lengthwise compartment or bunker located at the top of the cargo area, commonly referred to as an attic bunker. By its location, once filled with carbon dioxide snow, this attic bunker prevents any heat incursion into the cargo area through the car's insulated roof by intercepting it before the heat reaches the cargo. The bunker is quite large, so as to hold all the snow required for the long trips and covers the entire cargo area. In addition, the bunker is constructed so that both the carbon dioxide flash gas or vapor created when filling the lengthwise bunker with dry ice snow using liquid carbon dioxide, and the gas or vapor created as that snow gradually sublimes, exits the bunker at temperatures as low as about −110° F. through generous sized bunker vents (not shown as such in the Hill patent, but so in practice as the large volume of flash gas must pass through them to enter the cargo area) located all around and adjacent to the side and end walls of the cargo area. During bunker filling, with the frozen cargo (0° F. typically) already loaded, the doors closed and the exit vent open, the large volume of flash vapor leaves the bunker and forms what can be called a moving curtain or envelope of very cold carbon dioxide vapor passing sequentially through the ceiling space of the cargo compartment, next between the frozen food cargo and the four side walls and then under the cargo through the floor, as the vapor seeks the car's exit vent, all of which are especially located. These side walls (typically fiberglass or plastic) and the floor (typically an aluminum or magnesium T-bar type) are insulated and corrugated with grooves or channels open to the interior, all in a manner so that once the car is loaded with cargo, the walls, the floor and the cargo cooperatively effectively form a multi-channeled duct system, down the side walls and then out through the floor to the exit vent. The bunker vents and these spaces are generously sized (again not shown as such in the patent, but so in practice), so that the extremely high vapor flow rates occurring during bunker filling can be safely accommodated, and during bunker filling, virtually all the wall and floor channels are used by the exiting vapor. This fast moving enveloping curtain concept functions very well at the very high vapor flow rates occurring during bunker filling but very poorly after that (enroute) at the very low vapor flow rates resulting from the gradual sublimation of the dry ice in the bunker, and in most cases the exit vent is closed or nearly closed, so there is no directed through-flow.

The fast moving cold vapor curtain created during bunker filling of a Hill type car tends to sub-cool both the inside surfaces of the walls and floor and the outside surfaces of the frozen food adjacent to those surfaces by using the refrigeration of the exiting −110° F. vapor, thus the walls, some of the food and especially the aluminum T-bar floor, provide a heat sink to help intercept future heat incursions as they occur. Any "float," that is very small particles of dry ice created during the snow making process and carried in the flash vapor, adds to this initial cooling effect. The initial heat incursion may result from the rail car itself, even if it had been pre-cooled before loading, but had not sufficient time to become fully "cold soaked", a normal condition for such cars when primarily used in long-distance, one direction refrigerated service. After bunker filling is completed, the exit vent is typically closed, or nearly closed, so as to provide a positive pressure inside the car thus preventing harmful ambient air infiltration due to the movement of the car. Since all the air in the car was flushed out during bunker filling, the car thereafter (enroute) is near 100% carbon dioxide vapor, a desirable goal, as that indicates air infiltration (outside ambient air passing through the car and adding to the heat incursion) is not occurring.

Heat incursion enroute normally results from ambient conditions, including the sun's radiant effect, track heat, ambient temperatures, etc. The dry ice snow in the lengthwise bunker of the Hill car itself tends to intercept heat incursion through the car roof, where the sun's radiant load is most severe, some of the dry ice in the bunker subliming in the process, the −110° F. sublimed vapor falling through the bunker vents into the cargo compartment to aid in maintaining it cold.

It is a goal of virtually every type of cryogenic frozen food transportation system to maintain all the food very close to the proper (the loaded) temperature. To further cool any substantial portion consumes too much cryogen (in this case dry ice). To allow any portion to warm up, difficult to prevent in a passive system, and especially where the heat incursion is greater in some areas than in others, runs the risk of food deterioration and/or "blocking". Examples of possible high heat incursion areas into the cargo area are the door and the door frame areas, the corners and the floor. However, depending upon the heat transmission through the insulation of the bunker floor from the dry ice in the bunker and upon the random flow of vapor through the bunker vents (responding to a number of factors, including the rail car's orientation) to cool the cargo area is unreliable both as to all specific portions of the cargo area and to the seasonal differences in ambient conditions. This type frozen food is typically small pieces which are I.Q.F. (Individually Quick Frozen) and then loose packed in 35–40 lb. cartons, thus even if only localized warming of the outer cartons occurs enroute, the contents of that carton not only suffers severe quality deterioration, but some of the contents form one single mass upon refreezing when the food arrives at the car's destination and is stored at a 0° F. temperature again (blocking), an undesirable situation as that product is then visibly unusable, and nearby product becomes suspect and subject to rejection or argumental charge-backs by the consignee. If excessive refrigeration is supplied enroute, resulting in overfreezing of some cartons or reducing the temperature of some portions of the car, carbon dioxide/dry ice is wasted, but only in some very limited cases does physical deterioration of the food or packaging also result. These localized temperature deficiencies are shared by many other dry ice or cryogenic cooling systems, especially the no-moving part/totally passive systems and are the major challenges to the designers.

SUMMARY OF THE INVENTION

It is an object of the present invention to provide an improved rail car or other shipping container for refrigerated goods, such as frozen food, utilizing a bunker located above the cargo area which contains dry ice formed in situ (preferably after the frozen cargo is loaded into the cargo area) from liquid carbon dioxide. To refrigerate the cargo, it may then use (at the option of the designer): 1) the cooling effect of the flash gas created when the dry ice is formed, passing through vents from the bunker and then around the cargo, 2) the cooling provided by convectors located between the bunker and cargo area, and located near the cargo area walls, 3) the cooling provided by carbon dioxide vapor which, having warmed and risen through the vents into the bunker, is cooled and in combination with the sublimed carbon dioxide vapor, return to the cargo area through vents located near the side walls.

However, the most significant source of cargo area cooling results from the sublimation of the bunker's dry ice in re-cooling vapor in the cargo area which had been warmed by heat incursion through the car's side and end walls and through the floor. This re-cooling occurs by two principal means, the first and most well understood source of which is from the bottom surface of the bunker (being cold due to the heat leak through the bunker floor, even if insulated) which tended to maintain the top of the cargo area cool during a typical twelve day in-transit period, again, a portion of the dry ice in the bunker subliming in the process. Since $CO_2$ vapor, which fills the rail car, is lighter when warm and denser when cold, natural circulation of warm vapor up to the bottom surface of the bunker floor (cooled by heat transfer from the dry ice on the top surface of the bunker floor), and cold vapor down into the rail car naturally occurs. The second re-cooling source results from the very large size (not shown as such in the Hill patent) and location (shown in the Hill patent) of the bunker vents in the bunker floor of the Hill cars. Because of the typically long trips, a large amount of dry ice is needed and thus a very large quantity of vapor is created in the "flashing" process, resulting in the practical need to provide both a very large bunker and very large vents so as to not over pressurize the car. Generously sized wall and floor passageways/channels and exit vent are also provided in the car, all also sized so as to avoid excessive pressure build-up in the bunker during its filling, or elsewhere in the car. Subsequently (after the bunker is filled), the combination of the always open bunker vents' very large size, their location in the floor of the bunker and near the car's four (4) walls, the large size of the car and its bunker (especially it's length), and the unevenness of the railroad track enroute, all combine to cause the very cold and dense vapor laying on top of the snow in the bunker to tend to flow out whichever bunker vent(s) happens to be lowest or most convenient at that moment, and warmer vapor from the cargo area to tend to flow upward into the top of the bunker (from both density and displacement effects) through whichever bunker vent(s) happens to be highest or most convenient at that moment. By this means, the up effect a large heat exchanger, cooling the vapor rising into the bunker from the 0° F. cargo area by contact with the very cold snow there (snow subliming in the process) and the bunker's cold surfaces, and then returning the now much colder vapor to the cargo area. The just sublimed −110° F. vapor exits the bunker along with the just re-cooled vapor. This very cold combination then passes through vent(s) adjacent to the side and end walls (depending on the car's orientation at that moment) and tends, being very cold and dense, to immediately fall all the way to the floor through nearby wall corrugations, displacing warmer vapor back upwards, before exiting the rail car through whatever leakage path is provided or it finds. A crucial element in the value of this direct cooling which occurs within the bunker is that if the car enters a much warmer regime, the re-cooling supplied from the dry ice bunker increases, due to the enhanced circulation of vapor between the cargo area and the bunker. By all these means, it was attempted to maintain all the contents of the cargo storage area within desirable temperature limits during shipment.

The Hill car's function, thermodynamically speaking, by typically expanding nominal 0° F./300 psi liquid carbon dioxide for the bunker filling, which results in approximately 53% of the liquid carbon dioxide flashing to vapor, with the remainder becoming dry ice snow within the bunker. Assuming using 12 tons of liquid carbon dioxide, as Hill states, and a 30 minute bunker fill time, a typical time, a flash rate of approximately 425 lbs./min. of vapor occurs. At −100° F., approximately 2,500 cfm of vapor results (and the volume increases somewhat as the vapor warms up enroute to the exit vent) and the combined area of all the bunker vents, then all the side and end wall channels, then all the passages in the floor and then the exit vent must each be of sufficient area to accommodate this volume. Typically, less than 5 psig pressure drop between the bunker and the atmosphere is desired so as to prevent structural damage to the car, but this figure can vary with car or container construction. The time of filling can be lengthened somewhat if any of the vents or the channelized gaps between the side and end walls, the floor and the freight are insufficient in size to accommodate the volume of vapor being created without excessive pressure rise between the bunker and the exit vent, but long filling times are undesirable because of loading dock and car logistics. The percent given above for vapor and solid resulting from expanding carbon dioxide are theoretical and for 0° F. liquid, the use of colder liquid results in a somewhat lower percent flashing to vapor. In addition, practical results may vary, as in most cases, some very small particles of dry ice snow may be carried out of the bunker with the high velocity vapor, a type of dry ice snow generally called "float". The exact amount of float varies (including many other snow making characteristics), for a number of reasons, including the geometry of the orifice bore through which the carbon dioxide liquid expands, the temperature and pressure of the liquid carbon dioxide and whether an expansion snow horn (aglomerator) is provided, as well as the geometry of the snow deposit area in the bunker and the location of the flash vapor vent paths.

However, there are certain inherent design deficiencies in the Hill and similar systems, which while seemingly subtle and technical, are most important. One principal deficiency is that once the bunker is filled and enroute to the car's destination, the total amount of carbon dioxide vapor being created by sublimation of dry ice in the bunker is so greatly reduced that the resultant just sublimed vapor movement (leaving the bunker) is too small to need all the bunker vents and thus the vagaries of car and bunker orientation determine exactly which bunker vent it leaves from and which cargo area wall benefits from it. For example, on Hill's 12 day trip, the 47% of the original liquid carbon dioxide which becomes dry ice snow in the bunker (11,250 lbs.); sublimes at about an approximate average rate of ⅔ lb./min. or only 4 cfm of vapor, (a reduction of over 99% from the 2,500 cfm created when filling the bunker). With that small amount of sublimed vapor, a constantly downwards moving, enveloping curtain of exiting cold vapor from each and every bunker vent (as occurs during bunker filling) is not formed. Rather, the just sublimed vapor combines with any circulating vapor re-cooled in the bunker and both leave the bunker by whatever vent(s) happens to be lowest or most convenient at that time, both thence tending to fall or settle down the nearest wall corrugations in the process, displacing warmer vapor upwards. The total amount of re-cooled vapor has two parts: 1) the amount of vapor cooled by the cargo area ceiling (the bunker floor and thus indirectly from the dry ice subliming in the bunker), which is a function of the amount of insulation in the bunker floor/ceiling; 2) plus the amount of vapor circulating between the cargo area and the bunker and cooled by direct contact with the then subliming snow. For instance, if ½ the total sublimation is caused by re-cooling vapor by 100° F. Delta T, the amount re-cooled is less than 60 cfm, if the Delta T is less, the amount is greater, but each car trip can experience different results.

Accordingly, one sees that the bunker vents, walls and floor passageways of the Hill car, which must be sized large enough to readily accommodate the very large vapor flow occurring during bunker filling without excessive pressure drops, are also inherently large enough to readily allow random and unpredictable natural circulation from the cargo area and through the bunker and back to the cargo area during the subsequent enroute time, and unpredictably changing the snow's sublimation rate, sometimes favorably and sometimes unfavorably. The location of the large bunker vents near the four walls facilitates in the movement of warmed vapor up into the bunker area through some of the wall corrugations and thence through some of the higher vents, into the bunker area and then across the bunker (contacting the dry ice and becoming cooled) to lower bunker vents, then down some of the wall's corrugations to the floor, but it is all haphazard, depending upon the car's orientation at that moment. Natural circulation requires time for it to have an opportunity to occur, but when moving, a car's orientation can rapidly change, thus not be long enough in any position for any natural circulation pattern to establish itself. Alternately, it can be in one position too long. Accordingly, certain cargo areas received more cooling than required, and other areas less than required, not the desired result. Of especial importance, is the cooling is not predictably at areas of greatest need, where due to the structural details of the car's construction, the heat leak into the cargo area can be anticipated to be the greatest. Typical of such areas are the door(s), the corners (due to the bracing) or other such known areas individual to a car's design. This all results in inappropriate distribution of the enroute cooling through the vents in the bunker floor. If one considers the bunker filled with dry ice snow, the snow first sublimes/settles away from the ceiling (if the bunker was filled that far), reacting (subliming) to the dual impact of heat through the roof and through the bunker floor. The upper surface of the snow begins to resemble a combination mud flat with hills, and the very cold and dense vapor adjacent to that upper surface can be compared to water. Thus, as the car begins its trip, the initial vapor entering the bunker from the cargo area is cooled by the snow and then runs to the lowest or most convenient bunker vent, and thence into the cargo compartment. However, in so doing, it cuts channel like depressions in the remaining snow, leaving a favored path for future cold vapor run-off, even if the bunker vent it feeds isn't the lowest or most convenient at that moment. Also, as the trip progresses, the remaining snow can form dams, obstructing flow in some directions, but not so in other directions, all in a random fashion. Accordingly, some vents (and their adjacent wall corrugations) randomly receive more cold vapor than others, even if on the trip, the car's orientation is, on the average, level and theoretically, even distribution should occur.

Another deficiency of Hill and similar designs is that it can be seen that the amount of insulation between the bottom of the bunker and the top of the cargo area must be chosen so the refrigeration provided by heat leak through the floor of the bunker into the top of the cargo area, also considering the cooling effect of the resultant sublimed vapor (even though small), plus the vapor which rises from the cargo area into the bunker compartment (and is re-cooled there) and its resultant sublimed vapor which both return to the cargo volume; all taken together reflect the total and daily (and hourly and minute) heat load anticipated for the cargo area of the car. However, once the car is built, the amount of insulation cannot be readily changed so as to reflect the seasonal or route differences in daily heat load. Furthermore, the amount of vapor that rises into the bunker compartment (and the amount of cooling it experiences) is a random occurrence, being one unable to either predict or control. However, it should be noted that any heat incursion through the roof, whatever amount it may be, is intercepted by the bunker directly and the appropriate amount of dry ice sublimes.

However, the most subtle deficiency of the Hill '876 design (and shared by Fink '536 and many others as explained later) results from a lack of understanding of the crucial role the large bunker vents (located in the floor of the bunker and usually near the car's four walls) play in enroute cooling of the cargo area by promoting vapor flow into and then out of the bunker. Changes in car orientation and sublimation pattern of the snow in the bunker can have a destabilizing effect upon the natural circulation between the bunker area and the cargo area. Hill and the others make no attempt to control this, and accordingly the circulation randomly varies and uneven cooling of the cargo area results, the extent of which is almost an unpredictable and confusing trip-by-trip case.

This design deficiency is one shared by other prior art relating to rail cars, as none recognized the crucial and beneficial nature of properly located and large vents in promoting the beneficial flow of warm vapor from the cargo area into the bunker and of very cold vapor flow from the bunker down into the wall corrugations. Most much earlier art (prior to Rubin '266) utilized already manufactured dry ice in their containers, and thus only provided small bunker vents sufficient to accommodate the small amount of sublimed vapor, as it sublimed due to heat leak into it, but not large enough and/or located so as to promote vapor flow through the bunker.

Thus none taught using the dry ice itself to directly deep cool re-circulating vapor and methods to control its volume and placement. While Rubin '226 charges his bunker with liquid carbon dioxide, creating much vapor during charging, he only refers to his vents for "spent refrigeration egress."

Fink et al '536 maintains his bunker vents are only for sublimed vapor. The re-cooling of circulating cargo area vapor occurring by means of the heat leak through the bunker floor into the cargo area and the evolving sublimed vapor, taking little heed of the high heat of sublimation and low sensible heat of carbon dioxide (as shown in Table II) and thus that most cargo vapor is cooled by the cargo ceiling. This ceiling cooling method is used by many other prior art inventors for rail cars, trucks, or the larger shipping containers. Had Fink et al '536 utilized the bunker vent techniques of the present application, vapor circulation around the cargo would have been greatly improved.

Moe '969 speaks of distribution ports through which vapors formed from sublimation pass from the upper compartment (i.e. the bunker) into the lower compartment (i.e. the cargo area) downwardly around the perishables into the vent, also relying on heat leak through the bunker floor.

Thomsen '954 relies primarily upon heat leak through the bunker floor for cooling with his ports (in the bunker) being either sublimation ports or pressure relief ports.

Araquistain et al '479 speaks of the sublimed gas flowing downwardly through the bunker ports.

Shea et al '155 only vents the sublimed vapor from the bunker, either in passageways around the cargo or into the lower portion of the cargo area.

Mowatt-Larssen '717 teaches that his bunker vents are for the flow of carbon dioxide vapor from the subliming carbon dioxide snow in the bunker.

Weiner et al '622 states he provides mechanism to enable the carbon dioxide vapor produced during bunker filling and by sublimation to pass into the cargo compartment for maintaining the cargo in the frozen state.

Weiner et al '009 states that the sublimed vapor passes down through bunker vents into the cargo compartment.

Claterbos et al '193 teaches that the bunker floor should be insulated to the extent that the rate of heat transfer (cooling) through it is greater than that transferred to the carbon dioxide vapor in the cargo area. The bunker vents are for venting carbon dioxide vapor from the bunker into the cargo area.

Thomsen '013 teaches that his bunker vents allow cold vapor to move downwardly into the cargo compartment, either "flash" vapor formed when filing the bunker using liquid carbon dioxide or from subsequent sublimation.

None of these teach the desirable nature of warmed vapor from the cargo compartment flowing into the bunker itself to be deep-cooled there and returned selectively to the cargo compartment for maintaining the cargo in a refrigerated condition. None also teach the use of peripherally mounted convectors, which are in a heat conductions relationship with both the cargo area and bunker's dry ice. And none teach these two in combination.

In addition, it also has been common practice for the shipper to place flat cardboard sheets on top of the cargo so as to prevent "rain" from moisture laden outside air (entering the car upon opening the car door for unloading and the "rain" formed from that air contacting the very cold cargo area ceiling) soaking the uppermost cargo cartons. This practice also tends enroute to direct cold vapor from the bunker into the side and end wall corrugations, just as tilting a table tends to direct any water laying on it to run to one side, even if the bunker vents are not immediately adjacent to the side walls.

Gibot '010 describes a small container in which cargo area vapor may contact the dry ice; wherein warmer vapor may inadvertently find its way into the dry ice tray through the tray's loading door and thence out the same door, or through its grilled top thence out the same loading door, but the patent teaches that for frozen foods, the dry ice container is freely supported in the same compartment as the cargo, as the separator (or thermal shield, i.e. insulated bunker floor) is removed. Accordingly, the unit then functions much like Rubin '226 or the much earlier art covering mobile carts or the like, which like Gibot utilize already manufactured dry ice.

Convectors can be located so as to cool the most critical parts of the car or container and adjustable dampers can be provided so as to be able to change their cooling capacity prior to each trip. Inlet vent ducting and/or vent placement is also utilized to control and direct the flow of carbon dioxide vapor into and from the bunker, and adjustable dampers can also be provided if desired. By all these means, a variety of cars and containers, all with different constructional details, can be properly cooled.

This invention is very useful under conditions where the orientation (gradient) of the rail car or container is subject to regular and frequent change as usually occurs enroute. Larger containers, rail cars and trailers, unlike the small ones, are more subject to the orientation of the container changing the cooling patterns and relative heights of the bunker vents and thus the location the cooling is provided to. It is also very useful where seasonal variations occur. It is also very useful where different destinations or routes involve different climatic conditions. It is especially useful for larger containers, say over 600 cubic feet internal cargo volume (a nominal 8 ft. by 10 ft. By 7.5 ft. high) and for multi-day protection.

The table below illustrates the useful density differences of carbon dioxide vapor using the temperature ranges actually available. Temperatures warmer than 0° F. are questionable and those above +20° F. are dangerous to use with frozen foods, as partial thawing of many food products occur in the +20° F. to +30° F. range. However, most frozen foods are not harmed by −110° F. temperatures.

Table I $CO_2$ Densities at Various Temperatures and One (1) Atmosphere Pressure
Relative density of $CO_2$ vapor at various temperatures and 1 atmosphere pressure compared to its density at 0° F.

| Temp ° F. | Density in lb/Ft$^3$ | Difference from 0° F. - % |
|---|---|---|
| −110 | 0.173 | +31 |
| −80 | 0.162 | +23 |
| −60 | 0.153 | +16 |
| −40 | 0.145 | +10 |
| −20 | 0.139 | +5 |
| 0 | 0.132 | 0 |
| +20 | 0.127 | <4> |
| +40 | 0.122 | <8> |

NOTE:
Data from ASHRAE, Table 40, Refrigerant 744.

The following table illustrates some of the unique characteristics of liquid carbon dioxide when expanded to snow (solid carbon dioxide or dry ice) and vapor, especially the very significant difference in refrigeration potentials of the snow and vapor, the improved use of which form the basis for this invention. Of the total refrigeration provided by 0° F. liquid carbon dioxide, approximately 7% is in the flash vapor, 86% in the subliming dry ice and 7% in the sublimed vapor, assuming all the vapor exits the car warmed to about −30° F. Thus it is clear that the control and use of the subliming dry ice's refrigeration is the most important element of the refrigeration potential.

TABLE II

Approximate theoretical results of expanding isenthalpically (flashing) 800 pounds (typical bunker fill rate per minute) and 24,000 pounds (typical total fill amount) of saturated liquid 0° F. $CO_2$ at various equilibrium temperatures (° F.) to solid (dry ice snow) and vapor (flash gas) at atmospheric pressure, and refrigeration potentials of each element thereof, including that of the sublimed vapor.

| | | 800 lbs. | 24,000 lbs. |
|---|---|---|---|
| by weight | solid | 376 | 11,280 |
| lbs | flash vapor | 424 | 12,720 |
| by volume | solid | 9.4 | 282 |
| CF @ −110° F. | flash vapor | 2,500 | 75,000 |
| by refrigeration | solid | 91,700 | 2,751,000 |
| potential | flash vapor | 0 | 0 |
| @ −110° F., BTU | | | |
| by refrigeration | solid | 0 | 0 |
| potential, from | flash vapor | 8,050 | 241,500 |
| −110° F. to −30° F. BTU | sublimed vapor | 7,140 | 214,200 |

NOTES:
1) Volume of solid is an average (40 lbs/ft$^3$), as snow's density (like water snow's) varies as a function of how formed.
2) Data from Liquid Carbonic T-S Chart, form 6244, and ASHRAE Table 40, Refrig. 744.

The following Table illustrates the difference in bunker floor orientation that can be encountered for cars or containers of various lengths (or widths); due to the gradient of the rail bed (or highway or wave action). While railroad practice is to consider 2 to 2½% as the maximum, in mountains some tracks can reach 3% gradient. Interstate highways vary also, with 4% being reached in some mountainous areas. Pitching or rolling of ships or airplanes can cause even greater orientation shifts, depending on a number of factors. However, as Table III shows, the greater the grade (gradient) and the greater the dimension (with rail cars having the greatest of 80 ft.) the greater the effect on horizontal orientation. Large gradients can greatly increase the rate of convection cooling vapor flow through the bunker. This is a special area of concern for large containers which this invention addresses.

TABLE III

Effect of Grade (Gradient) Upon Horizontal Orientation (in inches) of a Rail Car Bunker Floor

| | Bunker Floor (width or length) | | | |
|---|---|---|---|---|
| Grade | 10 ft. | 20 ft. | 40 ft. | 80 ft. |
| ½% | 1.0" | 2.1" | 4.2" | 8.4" |
| 1% | 2.0" | 4.1" | 8.2" | 16.4" |
| 2% | 4.2" | 8.4" | 16.8" | 33.6" |
| 3% | 6.3" | 12.6" | 25.1" | 50.1" |
| 4% | 8.4" | 16.7" | 33.5" | — |

It should be remembered in such dry ice systems, that the cargo compartment and the bunker (and with the systems properly sealed to the atmosphere) becomes one closed system containing only carbon dioxide vapor. Virtually all air will be forced out. Circulation can be caused by warmer carbon dioxide vapor rising, but in dry ice systems can be more effectively caused by colder carbon dioxide vapor sinking, and in this process, each tends to increase the general circulation by displacing the other. It is more effective in 0° F. cargo dry ice cooling systems to maximize the design for the very cold vapor's great tendency to sink (rather than the warm vapor tending to rise), due to its density differences, as shown in Table I.

More current practice (for frozen foods) and including this invention, where the dry ice (i.e. "snow") in the bunker is created "in situ" by the expansion of liquid carbon dioxide is to arrange the bunker vents, the side walls with channels, the floor with channels, the exit vent to the atmosphere so that, with the car loaded with lading, the flash vapor created during the snow making process deep cools the side walls, floor and the side and bottom edges of the lading during the bunker filling process. The snow in the bunker provides the cooling effect for the subsequent trip, and this is the area of use to which this invention is directed.

Certain uses of cold convectors are described in Application Ser. No. 08/688,413, Jul. 30, 1996; but the present invention describes convectors' use, or bunker vents use, or combination vent/convectors or in combination with bunker vents with inlet ducting/placement. Either type of cold convectors, as well as the vents, can be adjusted with dampers prior to loading the car so as to either increase or decrease the rate of vapor being re-cooled by entering the bunker and the consequent dry ice sublimation enroute, and can be adjusted so the cooling is provided where most needed, due to car constructional details. The cold convectors are thermally connected to the bunker floor, which is made of a material with high thermal conductivity but are located near to or adjacent to the side and end walls. The use of this material tends to evenly sublime the snow throughout the bunker, thus minimizing the formation of snow dams at random locations. This use of so located convectors and large bunker vents results in better and more consistent temperature control which provides three benefits. First, better and more consistent temperature control improves the quality of foodstuffs; second, better and more consistent temperature control significantly reduces the amount of dry ice required; and third, better and more consistent temperature control extends the duration (and length) of safe shipment. In addition, a method is shown for pre-cooling the car, or re-cooling enroute, if required. Other methods of utilizing the various modes of this invention are also shown.

More particularly, it is an object of the invention to provide the designers of rail cars or containers utilizing carbon dioxide snow as the refrigerant and a bunker—with the design tools for enroute cooling that can be arranged to provide its cooling selectively and to be more responsive and suited to various enroute seasonal climatic conditions likely to be encountered (and at the user's option) and as well, provide more uniform cooling enroute to the cargo area than the Hill, Moe, Fink, Shea, Mowatt-Larssen, Araquistain, Claterbos, and Thomsen patents disclose. By these means, all the contents of the car or container can be better and more reliably maintained within acceptable temperature limits during shipment and less carbon dioxide will be required (or longer trips feasible).

In accordance with one illustrated embodiment, a rail car heavily insulated on all sides is provided with a lengthwise bunker at its top in which a deposit of carbon dioxide snow is located. The bottom of this bunker is provided with a lengthwise series of large vent openings, through which both the flash (when filling the bunker with solid (snow) using liquid carbon dioxide) and the sublimed carbon dioxide vapor may exit and the vapor from the cargo area to be re-cooled may enter and exit the bunker. The vents may be located near the side walls or in the center to best meet individual circumstances.

These bunker vents are sufficiently large that after bunker filling (enroute), vapor from II the cargo area can both readily rise through natural convection into the bunker through some, where it is re-cooled before returning through others to the cargo area. The inlet side of the bunker vents, that is the side within the bunker itself, can be provided (to the extent desired) with inlet ducting so as to effectively reduce the tendency of cold sublimed or re-cooled carbon dioxide vapor to drain from the bunker through those particular vents, and in that way reduce the random nature of enroute cooling. This inlet ducting will have little effect upon the flow of flash vapor from the bunker during bunker charging, due to the great amount of vapor created at that time and the resultant pressure differential. Bunker vents with inlet ducting will tend to return the warmer vapor of the cargo space to the bunker, and bunker vents located in or near the bunker floor will tend to return the cold vapor of the bunker to the cargo space. If the bunker has one or more side walls in addition to a bottom, the same effect can be created by having some bunker vents inlet higher and some lower, or a combination, and the vents' inlet height adjustable.

In addition, any desired number of near −100° F., cold convectors may be located around the periphery of the bunker floor, all so arranged to encourage natural convection enroute around and near to the walls, where it is most required (and not primarily cool the cargo space by direct heat transmission through the insulated bunker floor) and these convectors are not significantly effected by car/track orientation. When convectors are used, the upper surface, of the bunker floor on which the snow rests preferably will be constructed of a high heat conductive material, such as iron, steel, aluminum, magnesium or copper, and of sufficient thickness so as to facilitate maintaining the cold convectors very cold, even as the snow in the bunker sublimes away from the cold convector areas. Deep corrugations or small ridges or a separate highly conductive grill (not shown) on the upper surface of this material facilitate keeping the snow evenly dispersed, even if the car is on a great incline. While a highly conductive material such as copper can be a thinner upper surface than one of iron or steel, the minimum desired thickness is about 1/32". The portion of the bunker bottom away from the cold convector portion is heavily insulated on the cargo side, so as to minimize heat transfer there, refrigeration not being as needed there, as the top surface of the cargo is not subject to direct heat incursion, being protected by the bunker itself. When cold convectors are used, it is desirable that the heat transfer through the insulated portion of the bunker floor be arranged to be at least less than about 0.10 BTU/hr/Ft$^2$/° F. and through the cold convector portion of the bunker floor be arranged (when they are fully opened) to be at least more than about 0.50 BTU/hr/Ft$^2$/° F. The effective area of cold convector exposed to the car's interior can be adjusted by dampers so as to accommodate a number of variables. For instance, larger or smaller effective cold convector surface areas can be provided above side wall portions expected to experience higher or lower heat incursion rates (due to the car's constructional details or any other reason), or with built-in adjustable dampers, so as to adjust seasonally for the different heat incursion anticipated in winter or summer; or to adjust for different routes, or a combination of these. One arrangement is to space the cold convectors alternately with a high inlet ducted bunker vents (so as to create alternate down and up drafts with the vapor) near enough to the side walls to block heat incursion to the cargo therethrough, the up drafts occurring as a result of heat incursion, the down drafts as a result of the cooling from the cold convectors and any cold vapor from the bunker vents. Another arrangement is to utilize the cold section of the cold convectors as also be a low entrance bunker vent, combining the effects of cold vapor from the bunker with that from the convector. Each of the car's four side walls provide corrugations or channels open to the interior sufficiently sized so as to permit the natural downward flow of the very cold vapor to the floor and the natural upward flow of the displaced warmer vapor towards the ceiling and both along the outer surface of the load. Thus enroute (or at other times of low vapor generation rates), vapor warmed by heat incursion primarily through the walls can rise in those channels, be cooled either by the cold convector (which is kept cold by the dry ice in the bunker), or by entry into the bunker via a vent where it becomes very cold and thence settle out of the bunker back down the channels, all as caused by natural convection and enhanced by the locations of the bunker's cold convectors and bunker vents relative to each other and close to the walls' corrugations. Vapor created from the dry ice's sublimation adds to the effects.

In the center and wall bunker vent version of the rail car, the low entrance bunker vents located near any wall directly communicates with the dry ice in the bunker at a lower elevation than do the center bunker vents. By this means, the vapor created by sublimation enroute and any re-cooled vapor tends to add to the cooling effect near the walls, the exact wall depending upon the physical orientation of the rail car at that moment, and little (if any) vapor leaves the center bunker vents, except during bunker filling, re-filling or enroute cooling (if the special recooling manifold is provided), as the upper surface of the cargo is subject to minimum heat incursion.

The car's roof, its bunker floor and the car's cargo floor may be composed partially of high R superinsulation panels of the type known as AURA, TM of the Owens-Corning Fiberglass Corporation or similar flat evacuated panels from other manufacturers. AURA type panels have benefits beyond their insulating abilities in this railroad car including: a reduction in $C0_2$ use and allowing more space for the cargo, which frequently fills the car before the weight limit is reached. Accordingly, the side walls, floor and roof can benefit from inclusion of AURA panels in their construction. Another significant use of AURA is their incorporation into the bottom of the bunker, so as to reduce the amount of refrigeration passing through it to the interior of the car, except through the cold convectors, or by the flow of very cold vapor out through the bunker vents, which are located near the walls where the refrigeration is most desired. Thus, three benefits occur, one being space saving, another occurring where the balance between in transit time, heat leak of the car and bunker size requires lower sublimation rates and the third in reducing the heat transfer by radiation to the top surface of the cargo, where little is required, being protected by the bunker itself.

When designing insulated shipping containers of any type—rail cars, trucks, large or small containers for air, land or sea transport; the structural needs and the insulation needs must both be met. However, most frequently the structural needs impose higher heat incursion in one portion of the container than in others. The use of this invention allows the designer to then provide greater cooling to the areas where he anticipates higher heat incursion, matched to the individual needs of the shipping container.

THEORY OF OPERATION—CARBON DIOXIDE RAILROAD CAR REFRIGERATION SYSTEM

The theory of operation of this carbon dioxide refrigerated or frozen food in transit system is much different from any previously used on railroad cars, similar vehicles, or containers being transported by truck, rail, airplane or ship. It functions by uniquely being able to combine, as needed, in one physical embodiment any of four different effects: 1) the cooling provided by the flash vapor created when filling its bunker with dry ice using liquid carbon dioxide; 2) the cooling provided by the sublimed vapor generated enroute from the bunker, 3) the use of the refrigeration provided enroute from the subliming solid carbon dioxide in the bunker and 4) the use of the re-cooled vapor; all in a mutually supporting manner so as to create a passive and effective envelope type refrigeration system useful for substantial enroute times and one both able to be adjusted to seasonal ambient temperature changes, or to different routes having ambient differences and able to respond to ambient temperature change enroute; and under transit conditions where the car, etc. is frequently changing its orientation due to the gradient of the track (and similarly for trailers due to the roadbed, shipboard containers due to wave action and airborne containers due to the airplane's motion).

It thus recognizes the conditions of modem carbon dioxide manufacture and sale, where most large users' supply is in the form of liquid carbon dioxide (readily stored and distributed through pipes by the user at nominal 0° F. and 300 p.s.i.a.), rather than in the form of dry ice blocks (compressed "snow", at −110° F. and atmospheric pressure and usually requiring manual material handling to move). Typical large users of carbon dioxide today have a large quantity of liquid carbon dioxide stored at the using site and pipe it to the using point. If dry ice is desired, the liquid is expanded through orifice devices (in some cases including congealing devices known as "snow horns") to atmospheric pressure, changing in the process to a mixture of solid and vapor. A form of solid dry ice results, known as "snow", as it greatly resembles natural water snow, except it is much colder (−110° F.) and has a very large heat of sublimation (244 BTU per lb.) occurring as it turns directly to vapor when heated. The evolving vapor portion is initially also at −110° F., but only has a sensible cooling capability of about 22 BTU per lb. when warmed to 0° F. A variety of carbon dioxide using devices cool in this manner and some examples are described in U.S. Pat. Nos. 3,660,985; 3,672,181; 4,344,291; 4,356,707; & 4,695,302 all issued to Lewis Tyree Jr. The stored liquid carbon dioxide can also be at other temperatures and pressures, and even be a "slush" (mixture of solid and liquid).

Current U.S. practice for cryogenic railroad cars and the like is to expand liquid carbon dioxide through an orifice or an orifice like expansion device (so as to create the desired dry ice) inside a bunker which in turn is inside the car, the bunker extending above the ceiling of cargo area, just as an attic in a house. However, in doing so, approximately one half the 0° F. liquid carbon dioxide flashes to −110° F. vapor at the same time the dry ice snow is being created, i.e. during the bunker filling operation, and this very cold vapor must be allowed to rapidly escape, or severe pressure build-ups occur. The dry ice remaining in the bunker provides the principal enroute cooling.

This invention recognizes that accordingly, such a vehicle carbon dioxide dry ice bunker system (where liquid carbon dioxide produces solid dry ice "in situ" within the bunker) requires two separate, distinct and quite different operating modes, but that must each function from the same bunker system and in a complementary manner. Both operating modes utilize the fact that most frozen foods can be substantially sub-cooled (below 0° F.) without damage, but cannot be allowed to warm up much above 20° F. (and some even should be maintained colder, i.e. cold water fish and others).

The first mode, occurring when filling the bunker, is directed at utilizing the approximately one half by weight of the incoming liquid carbon dioxide which passes through the orifices and flashes to vapor at −110° F. (the other one half becoming dry ice snow), thus rapidly creating a great quantity of very cold vapor, which must immediately exit the bunker. For such applications where the bunker is large, the orifice device's exit bore can be extended and then counterbored with a taper reamer, or similar method, creating a smooth, conical exit path. This aids in congealing the snow, giving directional velocity to it (so as to better fill the bunker) and results in less float. To best utilize this large quantity of very cold vapor, when frozen food or similar cargo is being transported, the cargo is loaded (prior to filling the bunker) tightly to all side walls, but with a space above the cargo, just below the attic bunker. This space is needed for two reasons, first providing room for the fork lift to elevate the pallets of cargo off the floor so as to move them into the vehicle during loading (or off during unloading) and in addition to provide a plenum for the flash vapor to enter the cargo area from the bunker vents and to then more evenly disperse itself to the channels in the four side walls. The side walls are constructed with open to the interior three-sided channels, as is the floor (thus when the cargo is snugly in place, cooperatively forms four sides). This one-side open channel feature is most useful, being of great value when cleaning the car between trips. The bottom of the side walls have a manifold-like open connection and are so arranged that when the car is loaded, to form passages so the flash vapor driven down the corrugations in the side and end walls by pressure differential, exits from the side and end walls near the floor and is gathered to one end where it then passes through the floor channels before exiting the car through a vent sufficiently large to readily accommodate the flash vapor. The floor channels are typically metal so as to hold and retain the cooling effect of the flash vapor passing through it. Thus, this portion of the invention utilizes the flash vapor to effectively sub-cool both the interior surfaces of the sides and floor (and to also simultaneously sub-cool that portion of the cargo next adjacent to the sides and floor). This sub-cooling of the floor area during bunker filling is most important as it acts as a future barrier to enroute heat incursion from below. Accordingly the floor, where enroute heat incursion is great, is preferably made of heavy aluminum or other quick to cool heat retention materials, so as to maximize the future barrier effect. For non-frozen foods, i.e. above 28° F., i.e. "fresh " the flash vapor can be vented direct to the atmosphere from the bunker, or conducted under the floor (not shown).

The second mode occurs once the bunker is filled and the car is enroute and this second mode consists of two complimenting elements. Very little vapor is created from the dry ice in the bunker as it sublimes, but a great deal of refrigeration is produced, as, on a pound for pound basis, over about 10 times the refrigeration is available from sublimation as from warming the −110° F. sublimed vapor (see Table II). Accordingly, to utilize this subliming refrigeration effect so as to promote consistent and predictable vapor circulation in the cargo compartment (and the first element of this second mode), cold convectors or very cold portions of the dry ice containing bunker floor/cargo ceiling, can be provided. These cold convectors are located so the ability of the subliming dry ice to re-cool cargo compartment vapor is preferential to where it is most required, i.e. to intercept side and end wall and floor edge heat incursions before they reach the cargo. Thus the cold convectors are provided where needed around and typically near the four sides, so the vapor cooled by the action of the cold convectors is sufficiently close to all side walls that each (and the outer edges of the floor) regularly receives its cooling benefits, despite the fact that the car isn't always level, as the track is frequently sloped front to rear or side to side to match the terrain the railcar traverses. The periphery of the cargo is thus protected (the bunker protects the top) by both the natural tendency of warm vapor to rise and cold vapor to sink. Since both these actions are caused by relative density (in this case, a function of the vapor's temperature per Table I, as the interior of the railcar quickly becomes 100% carbon dioxide vapor), the cold convectors are arranged and located so as to be more effective by providing a number of small falling streams of very cold vapor down the side walls, much as a series of small waterfalls operate (as opposed to larger streams of slightly cold vapor), no matter whether the rail car is level or not. These cause a substantial downflow effect through some of the side and end wall corrugations to the bottom manifolds, where warmer vapor is displaced back up to the cold convectors through nearby channels. Most prior systems operate on the theory that vapor warmed by heat incursion rising, and then being cooled by contact with the cargo side surface of the floor of the bunker, but with no specific routes or provision for return. With such systems and with frozen foods, undesirable "spot" warming of the foods can occur before a meaningful warmer vapor density difference occurs (see Table I). However, with dry ice cooled cold convectors, meaningful colder temperature differences (and density differences) can be created, as most frozen foods can safely tolerate much greater temperature differences below 0° F. than above 0° F. In a related improvement, the cold convectors are provided with adjustable dampers so that the volume and/or temperature of vapor being re-cooled can be adjusted for a number of reasons including: seasonably (more and/or colder vapor in summer, less and/or warmer vapor in winter), or routes through different climates, or to compensate for known high heat incursion areas, i.e. around the doors or corners. In another related improvement, the cold convectors are arranged with extended surface on their cargo side, in a manner that is able to promote very cold exit temperatures of the vapor and thus very cold and dense vapor and enhanced downward circulation. The cold connectors can be a variety of designs, from complex to simply extensions of the heat conductive bunker floor top surface. Cold convectors can be used both for frozen operation or fresh operation.

The second element of this second mode, also so as to promote consistent and predictable vapor circulation enroute in the cargo compartment, is to provide bunker vents arranged so as to both promote flow of warm vapor from the cargo area into the bunker where it is cooled by the dry ice there, mixed with the very cold vapor subliming from the dry ice and to promote the return of this very cold mixture to the cargo compartment through other vents, all arranged so as to promote the flow of this colder vapor into selected places near the side and end walls. Generally, when using 0° F. liquid carbon dioxide, the total cross section area (open) of all these vents should be about at least about 3% of the area of the bunker floor or the normal surface of the dry ice within the bunker (the normal surface being that of the dry ice when the bunker is filled, but the top surface flat, an example being when the bunker is a trapezoidal or such shape—not the more normal rectangular or square). Larger vent areas allow more rapid bunker filling, and smaller vice versa. If these bunker vents are located on the sides of a bunker, rather than in the bunker floor, those promoting warm vapor flow into the bunker are located higher on the side(s) than those promoting colder vapor flow from the bunker. The favored position for the lower vents is communicating directly with the bunker floor itself, so the cold vapor can always directly drain, even if the level of snow in the bunker is very low, thus promoting better circulation between the cargo area and the bunker and thus more cooling of the warmer vapor rising into the bunker. The functions of the vents and the cold convectors can be combined, both combining the re-cooled return warm vapor portion and the colder vapor portion, either singly or jointly. If it is desired to envelope the sides and bottom of the cargo with circulating vapor (as Fink et al '536 attempted), one method would be to place high entrance vents on one side of the bunker, and low entrance vents (or combination vent-cold convectors) on the other. Bunker dividers can also be provided, to better direct the vapor circulation through the bunker. Furthermore, except for screens, vents arranged for warm vapor return to the bunker should have no open area dimension less than about ½" and those arranged for cold vapor to the cargo area should have no open area dimension less than about ⅛" so as to promote this natural circulation. Such through the bunker cooling is most useful for frozen temperature operation.

Another possible bunker arrangement is an array of centrally located flash gas inlet ducted vents (as well as peripheral vents), ensuring improved dry ice snow dispersion during filling of the bunker. In addition, arranging for some of the flash gas to enter the plenum above the cargo in its center tends to produce gas/vapor flow more evenly down all sides (dispersing itself through the multitude of channels), thence through the floor, all as the vapor seeks the large flash vent exit during both bunker filling. Alternately, all vents can be located near the side walls. Any enroute sublimed vapor vent exit(s) is much smaller than the flash vapor vent and also provides a small back pressure, and encourages enroute venting, if occurring (although door seal leaks, etc. may dominate, making it's use unnecessary) after passing under the cargo. A positive pressure inside the car enroute is desirable, so outside air infiltration (and consequent heat incursion) due to wind velocities, train speed, etc. is minimized.

As can be seen, the different elements of the invention can be combined in a number of different manners, so as to meet all the varied needs of the refrigerated car and container market.

Other optional improvements include: 1) the use of AURA high R vacuum flat insulation panels or similar enhanced insulation panels, in areas of great utility, either where heat incursion is most difficult to counteract by re-cooling the vapor, such as the rail car's floor, or their use in the car roof where the sun's radiant heat is the greatest or in the dry ice bunker floor, so as to increase the effect of the cold convector portion and reduce the bunker floor's general cooling effect to the top of the cargo; and 2) providing a separate liquid carbon dioxide manifold, located directly above the main center vents and spraying dry ice snow and/or vapor downward through them; so as to either pre-cool the car before loading, if desired, or to re-cool the car and cargo enroute, if needed.

A BRIEF DESCRIPTION OF THE DRAWINGS

FIG. 1, in one embodiment, is a perspective view partly broken away of a refrigerated railroad car incorporating the present invention.

DETAILED DESCRIPTION OF THE PREFERRED EMBODIMENTS

NOTE 1: In all drawings where carbon dioxide flow is shown, a single headed arrow indicates vapor phase flowing. Where the solid phase is shown in section, the symbol for "chemical solution, gases or their like" is used.

NOTE 2: The meaning of the word "near" as used herein with regard to vent or convector location is "not far from". When this meaning is applied to vents, convectors or combination vent/convectors positions relative to the side walls of the car or container, it encompasses all positions between immediately adjacent or contiguous to closer to one of the side walls in a pair than to the other side wall of that pair.

Figure 1:
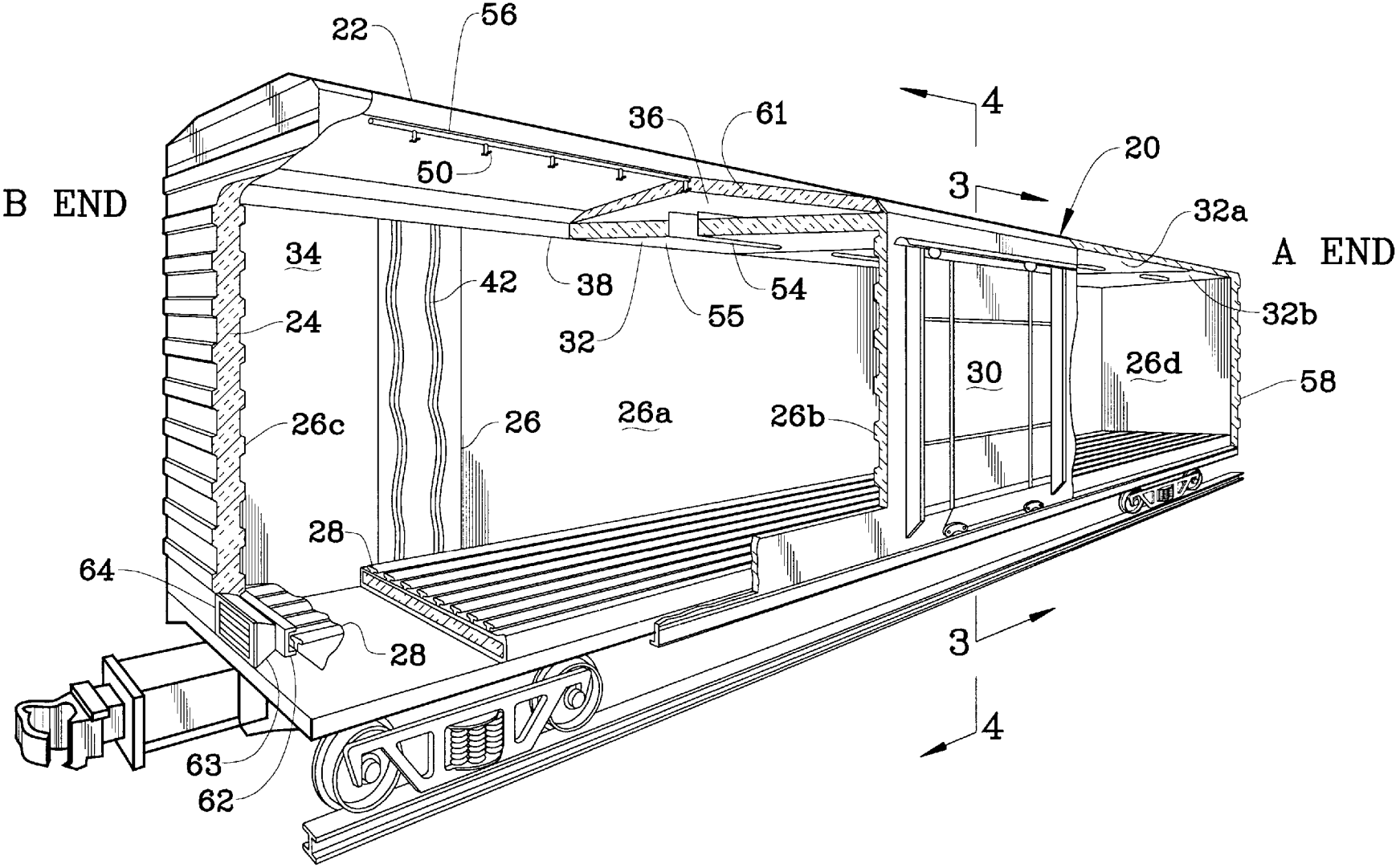

FIG. 1, 2, 3, 4, 5, 6 & 7 show a refrigerated rail car 20 constructed in accordance with various embodiments of the present invention. First looking primarily at FIG. 1, the rail car 20 comprises a conventional exterior outer shell 22, insulation 24, inside paneling 26, and a channeled cargo floor 28. The paneling 26 includes side walls 26*a*, 26*b* and end walls 26*c* and 26*d*. A sliding door 30 is provided centrally on at least one side wall of the railcar 20. A false ceiling/bunker floor 32 is provided to divide the inside of the railcar 20 into a cargo area/compartment 34 and a bunker area/compartment 36. The bunker floor 32 comprises individual panels 32*a* and 32*b* arranged side to side inside the railcar 20, with panels 32*a* between one panel 32*b* on each end, all supported on lengthwise ledges 38. The ledges 38 can be of a plurality of designs including L-shaped brackets.

The wall paneling 26 extends at least from the bunker floor 32 down to the channeled cargo floor 28. The side and end walls 26*a*, 26*b*, 26*c* and 26*d* comprise corrugated fiberglass panels forming rows of sinuous or straight channels 42, open sided toward the interior of the cargo compartment 34. Sinuous channeling is generally preferred because the channels 42 are less likely to become blocked by inadvertently loaded cargo or shifting cargo enroute.

The floor 28 comprises lengthwise channeling underneath the cargo 44. The floor 28 can be a T-type cross sectional shape of the type described in Lemon U.S. Pat. No. 4,091,743 issued May 30, 1978 or variations thereof, with the flat head portion of the T supporting the cargo thereabove. The Lemon T shapes can, if desired, include a 0° F. phase change material for frozen good use or other cold retention methods so as to enhance the floor's cold retention capabilities. Specifically, the floor material should have at least the thermal conductivity and specific heat properties of iron. Aluminum or magnesium is preferred. To enhance the cold retention characteristics, the floor can be selected from thicker material or inserts can be added. The inserts can be metal rods or can be suitable tubes filled with a material which experiences a liquid/solid phase change near 0° F. As will be described hereinafter, the channeled flooring 28 is arranged to provide a flow of carbon dioxide therethrough.

The centrally located vents 54 have extended shielding on the inlet (bunker side), so that flow of vapor, once bunker filling is complete, into and out of the bunker is primarily through periphery located high vents 55 or low vents 55*a*, located near the side walls.

Above the bunker floor 32 and generally spanning the length of the railcar 20, is a manifold pipe 56. Railcars are generally described as having an "A" end and a "B" end, with the B end being the end having the brake. The manifold pipe 56 proceeds into the A wall 58 of the railcar 20 and extends downwardly to emerge on the outside of the railcar 20. The manifold pipe 56 serves to conduct a supply of pressurized liquid carbon dioxide into the bunker area 36. Discharge of the liquid carbon dioxide from the manifold pipe is through suitably sized orifices 59 and is an isenthalpic expansion process. When liquid carbon dioxide so expands, a portion becomes vapor, commonly called flash vapor and a portion becomes dry ice, commonly called snow 60. The nozzles or orifices 59 are formed and directed so that the flash vapor and snow 60 tend to separate, with the snow 60 remaining in the bunker area 36 on the upper surface 61 of bunker floor 32 and the vapor escaping by means of centrally located vents 54 (having extended bunker side ducting) preferably located near to and beneath the manifold 56 or by means of vents 55 or 55*a* located near the side and end walls.

At the B end of the car, the channeled floor 28 opens to a vent duct 62 which exits to a vent box 63 which provides an exit for vapor to the outside. A manually operated vent box door 64 closes or opens the exit. A relief duct and burst disc (not shown) may be optionally provided for relieving the bunker area 36 or the cargo compartment 34 of railcar 20 of any overpressure that may occur.

Figure 2:
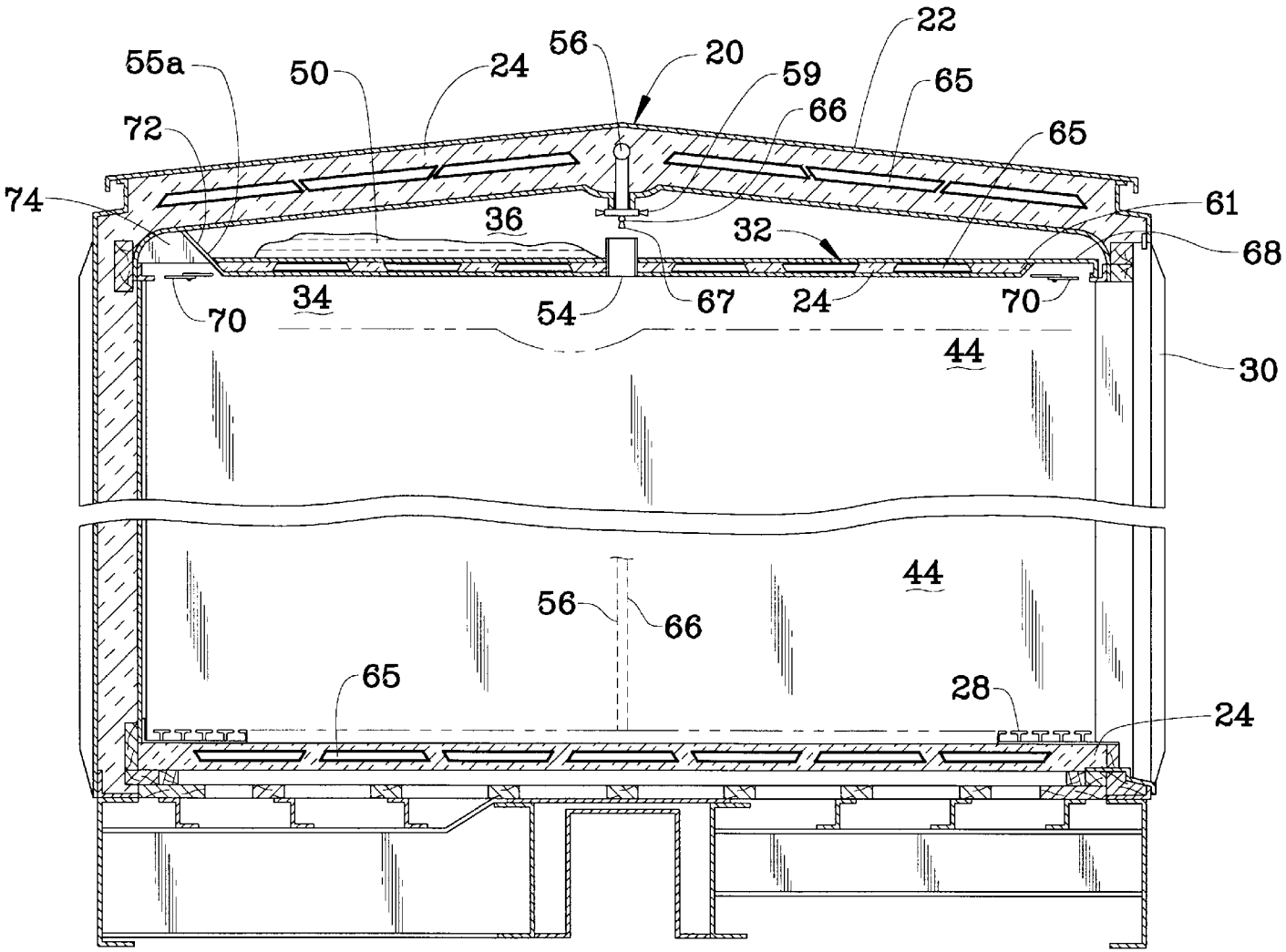
FIG. 2 is an enlarged, fragmentary cross sectional view of the railroad car of FIG. 1, looking in the direction of the arrows 3—3.

FIG. 2 shows the car in more detail looking in the direction of arrows 3—3 of FIG. 1 with the bunker containing dry ice 60 and the car loaded with cargo 44, all as if enroute. Inserted into the insulation 24 above and below the bunker area 36 and below the cargo floor 28 are AURA flat vacuum panels 65. Optional auxiliary manifold 66 is located below manifold 56, and its orifices 67 are directed through the optional center vents 54, and is useful for precooling the railcar or for rapid re-cooling enroute, if required. Other arrangements (not shown) which incorporate the same concepts can be used. The right side of FIG. 2 shows simple cold convectors 68 and cold convector dampers 70. The left side shows an alternate combination vent/cold convector 72 (shown in FIG. 5) arrangement, which includes optional extended surface 74 and a bunker vent 55*a* which are both included so as to provide very cold vapor (denser). Cold convectors 68 or 72 are typically thermal extensions of the bunker floor surface 61, which is fabricated from a heat conductive material, such as aluminum, and of a thickness (at least about 1/32") so that by convection the cold convector surface is maintained at near −110° F. temperature, even as the snow 60 in the bunker sublimes, the bunker floor surface 61 conducting heat through itself from the area where dry ice snow remains to the cold convectors 68 or 72, even as the snow 60 becomes partially used up or if shifting occurs enroute. For the same reasons, bunker panels 32*a* and 32*b* are preferably connected together so that all bunker floor panels 32 thermally connect to each other.

Figure 3:
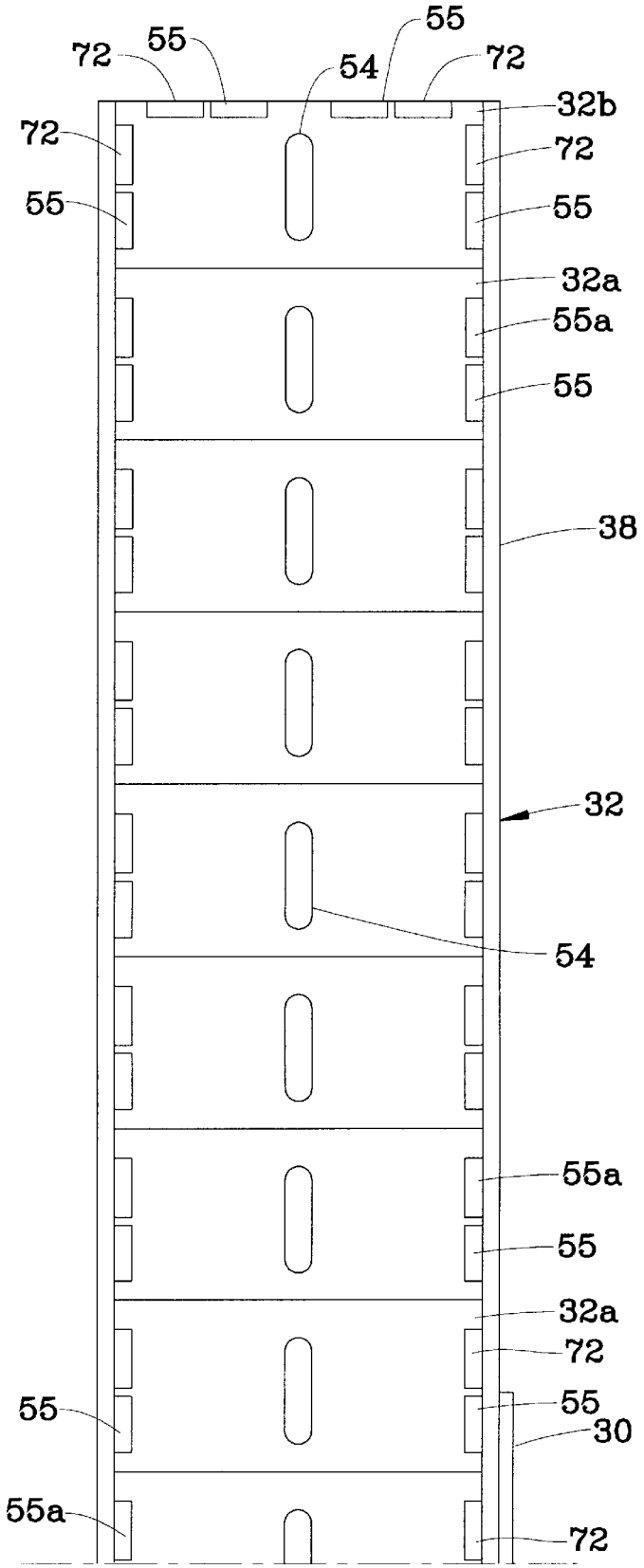
FIG. 3 is a half-length plan view of the bunker floor of the railroad car of FIG. 1, showing the location of 17 optional center vent holes and the location of 39 cold convectors and 39 edge vent holes in the bunker floor.

FIG. 3 shows a half length plan view of the bunker floor 32 looking upwards from the cargo compartment 34, showing one arrangement of possible locations of the combination vent/cold convectors 72, and bunker floor vents 55 or 55*a* placed near or not far from the walls 26*a*, 26*b*, 26*c*, and 26*d*, vents 54 (near the lengthwise centerline) and location of panels, 32*a* and 32*b*.

Figure 4:
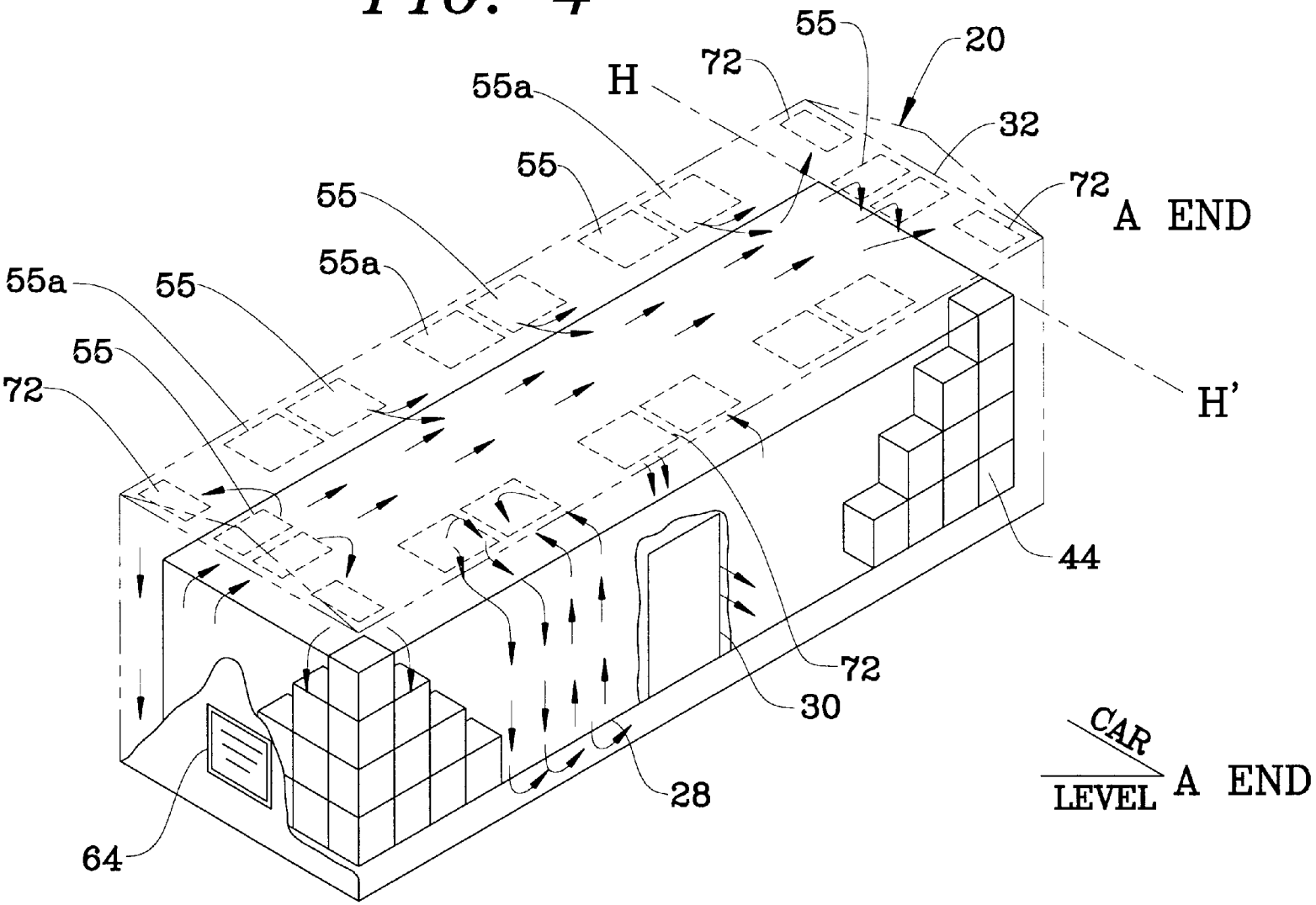
FIG. 4 is a simplified, reduced, perspective view of the railroad car of FIG. 1 depicting the flow patterns of $C0_2$ vapor when bunker filling has been completed, as if the car was loaded with freight, showing all three methods of cooling the cargo area, i.e. convectors, through bunker floor, and cold vapor from the bunker itself.

FIG. 4 is a perspective view of the railcar of FIG. 1 (less the roof portion of the outer shell 20) and with the bunker vents generally of FIG. 3, but without the center vents 54; arrows showing the vapor flow occurring when the railcar is enroute, and as if the railcar was loaded with cargo 44, tightly to the inside of wall panelling 26 and to a height of 6 or so inches from the cargo area 34 ceiling 32, indicated by line H—H' and with the vent box door 64 closed and on track wherein the A end is lower than the B end, except the railcar's details have been simplified for clarity, and only partial vapor flow of one combination vent/cold convector 72 and of vents 55 and 55*a* is depicted. It is assumed vapor exhausts the car by leakage around the door seals or through the floor drains.

Figure 5:
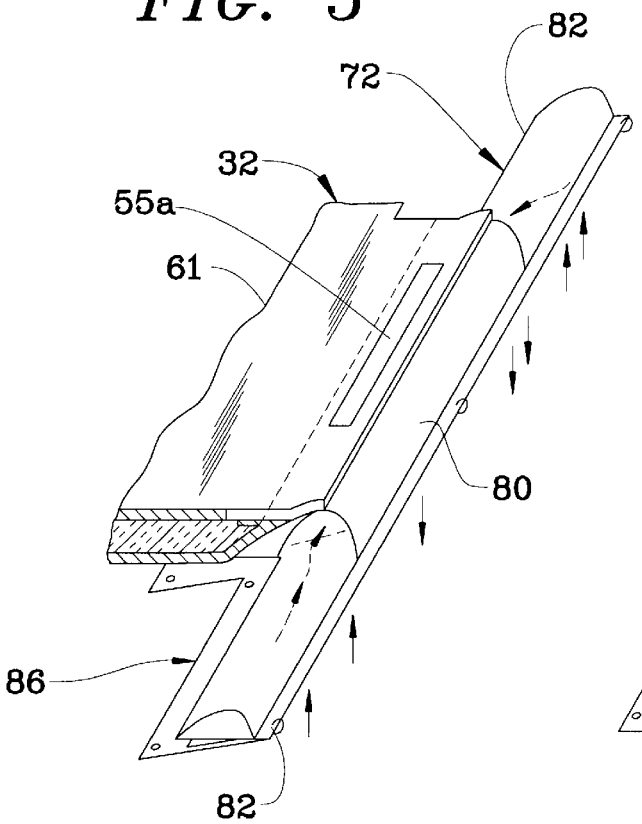
FIGS. 5,5A,5B & 5C are perspective views of a typical combination convector and low bunker vent.

FIG. 5 shows a combination vent/cold convector 72 as it would appear looking downward and as connected so as to have a good thermal bond to the bunker floor upper surface 61 of the bunker floor 32. The combination vent/cold convector 72 has three chambers, a center convector cooling chamber 80 with a return vapor chamber 82 on either side, each return chamber 82 collecting the rising warmer vapor from the railcar and returning it to the center convector portion 80 for subsequent cooling resulting from the subliming dry ice 60 in the bunker and then dropping the re-cooled vapor to the cargo compartment 34. The vent 55*a* (in addition to it's vent function during bunker filling) allows the sublimed vapor to mix with the re-cooled vapor, thereby enhancing the circulation. Of course, for corners or other special locations of the railcar, the vent/cold convector 72 could be made with just two chambers, one cold convector center chamber 80 and one return vapor chamber 82, or other similar functional arrangement.

Figure 5A:
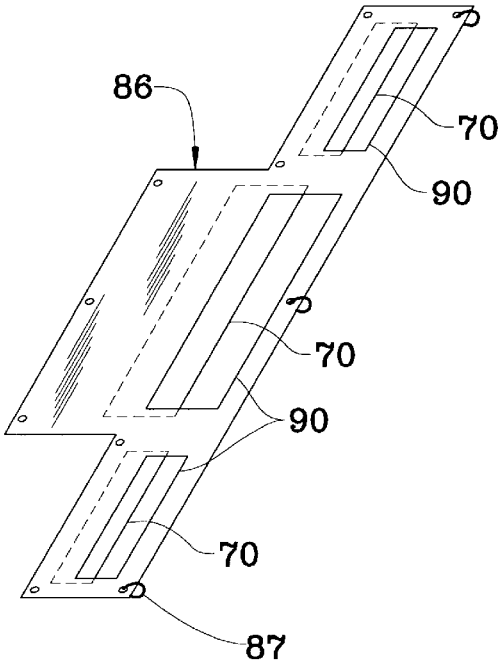

FIG. 5A is a cover 86, hinged to the cargo side by hinges 87 so as to allow cleaning, containing adjustable dampers 70 covering, to the extent desired by anticipated weather conditions or car 20 constructional details, openings 90 in the cover 86 which communicate from the cargo compartment 34 to the interior of the combination vent/cold convector 72.

Figure 5B:
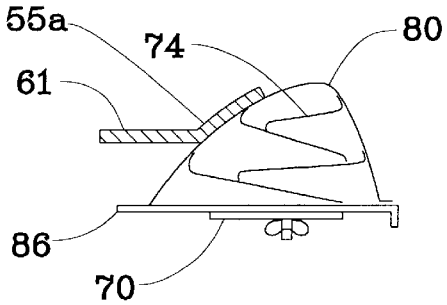

FIG. 5B is a cross sectional view of a combination vent/cold convector 72 center chamber 80 showing the extended surface 74 and location of the vent 55*a*.

Figure 5C:
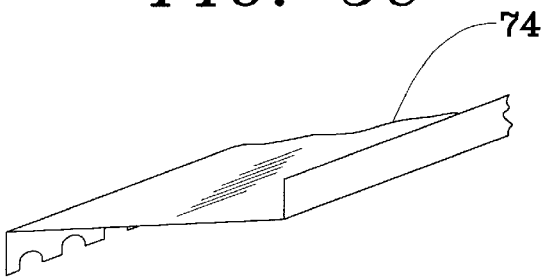

FIG. 5C is a detail of a typical extended surface 74, which assists in cooling the warm vapor in the combination vent/cold convector 72.

Figure 6:
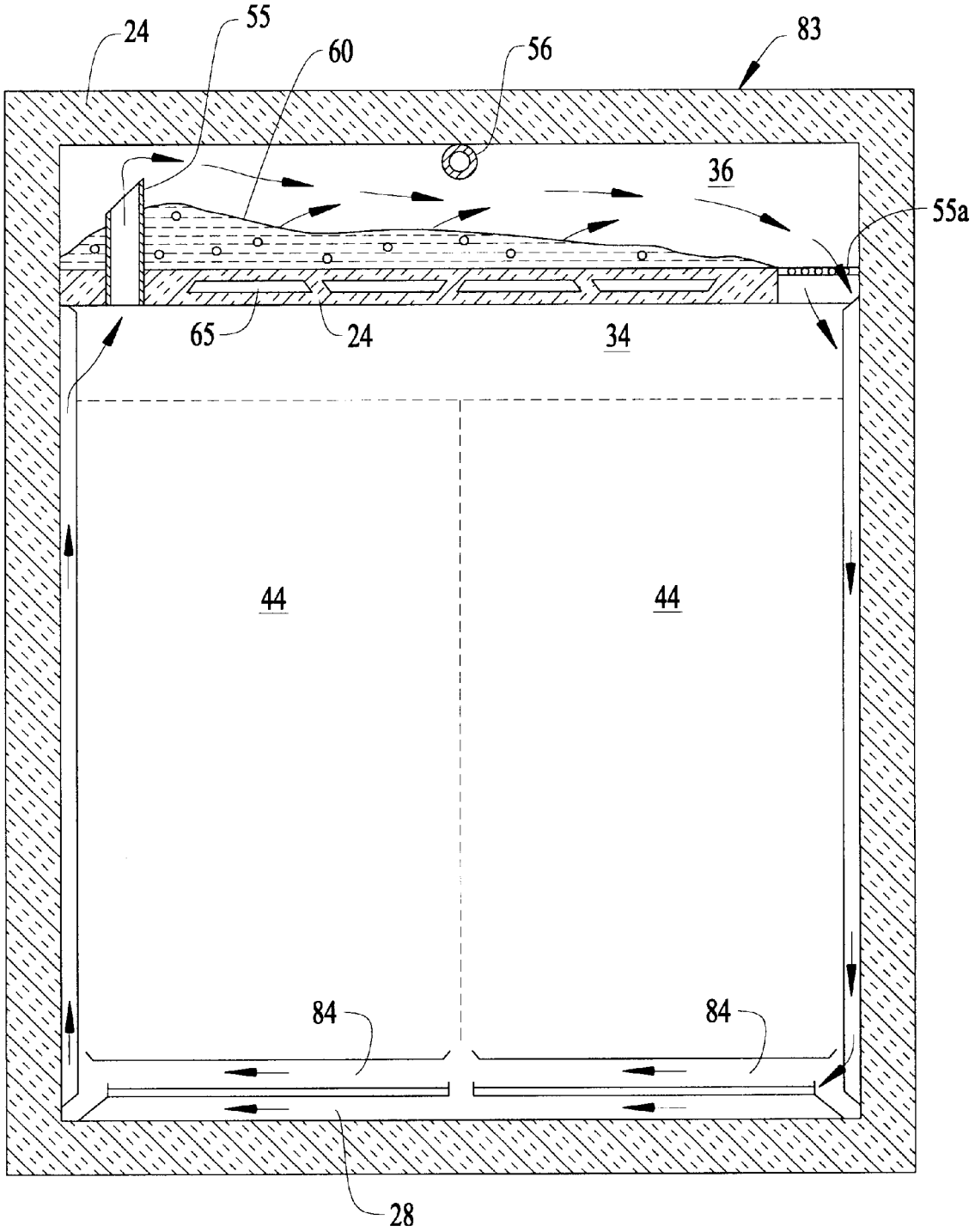
FIG. 6 is a simplified, cross sectional, perspective view of a railroad car with cargo loading, side walls and pallets similar to the Fink et al '536 patent, but with bunker vents according to the present invention.

FIG. 6 shows the movement of vapor in a car or container 83 of a different shape after cargo and bunker loading and with inlet ducted (or high) bunker vents 55 along one side, and with floor bunker vents 55*a* along the other side, the cargo 44 loaded on pallets 84 having traverse openings, so that an envelope of constantly circulating vapor is created around the cargo. In this case, the channels in the floor 28 may be transverse, rather than longitudinal. Combination vent/cold convectors 72 or simple cold convectors 68 may be used in place of some or all of vents 55*a* (not shown).

Figure 7:
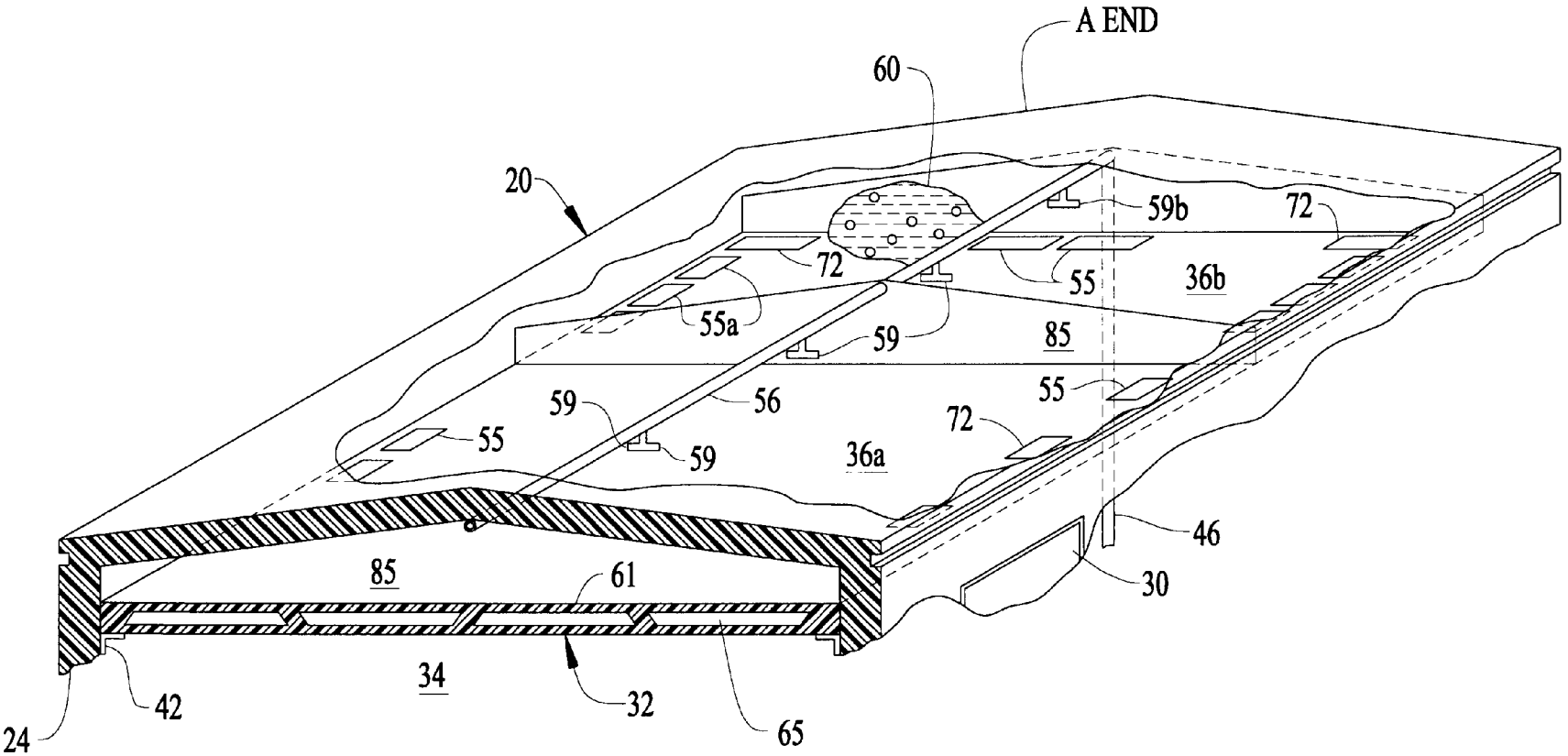
FIG. 7 is an enlarged, fragmentary cross sectional view of the top of the railroad car of FIG. 1, looking in the direction of arrows 3—3, showing a compartmentalized bunker.

FIG. 7 is a two thirds perspective view generally of the bunker floor 32 of FIG. 4 looking downward through the roof of car 20, the bunker of the car, but with the bunker 36 subdivided into separate compartments 36*a* and 36*b*, each of which has an independent snow supply system (orifices 59) and vents 55 or 55*a* or combination vent/cold convectors 72. Bunker dividers 85 extend essentially across the bunker, creating horizontal like dams. If vapor relief ports are desired to connect the separate bunker compartments, such ports are preferably located high in the divider 85 (not shown). If desired, the number of vents 55 or 55*a* or cold convectors 68 (not shown) or combination vent/cold convectors 72 can be increased over areas of known high heat incursion (i.e. over the door 30 as in compartment 36*a* or over the car's corners as in compartment 36*b*). Another option as shown in compartment 36*a* is to place more orifices 59 directing snow to the door 30 side of the bunker; also to use over-size orifices 59*a* in compartments over areas of anticipated high heat leak (as the car's ends, A or B) and also to use orifices 59*b* constructed so the corners of the compartments fill with snow 60. If simple cold convectors 68 or combination vent/cold convectors 72 are used, the upper surface 61 of the bunker floor 32 is preferably of a heat conducting material, such as aluminum or copper. This arrangement tends to restrict vapor flow through long bunkers when the car is not level.

Although the invention has been described in considerable detail with particular reference to a preferred embodiment, variations and modifications can be effected from the above disclosure by those skilled in the art who carefully review it. Therefore, the present invention is not to be limited by the above description, but is to be determined by the spirit and scope of the following claims.

I claim:

1. In an insulated railroad car or other cargo container having an internal cargo volume of at least 600 cubic feet, for maintaining cargo in a refrigerated condition by the use of carbon dioxide as an expendable refrigerant, the car or container having a top, a pair of opposed side walls, a pair of opposed end walls, a bottom and a bunker having a floor and a vent(s) for carbon dioxide vapor, the bunker positioned beneath the top and above a cargo volume, a manifold pipe positioned so as to provide a supply of carbon dioxide snow on the floor of the bunker, the bunker floor providing at least in part a ceiling for the cargo volume, the improvement comprising an area of heat conductive material as the upper surface of the bunker floor to be maintained at a near uniform temperature by contact with the carbon dioxide snow in the bunker, one or more convectors located in or near the ceiling of the cargo volume and near to the side and or side and end walls of the car or container, said heat conducting material to be in direct thermal communication with both the carbon dioxide snow in the bunker and the convectors, a layer of insulation in the bunker floor between the heat conductive material and the cargo volume leaving the convectors exposed, whereby the cargo is uniformly maintained in a refrigerated condition by heat exchange between vapor in the cargo volume and the convectors.

2. The railroad car or container of claim 1 wherein adjustable dampers are provided at least in part covering the convectors communicating with the cargo volume so that more or less cooling is directed to the sides and ends of the cargo volume when it is anticipated such more or less cooling rate is advantageous.

3. The railroad car or container of claim 1 wherein extended surfaces are part of the convectors so that greater cooling of the carbon dioxide vapor in the cargo volume is provided.

4. The railroad car or container of claim 1 wherein the heat conducting material is in the form of a metal panel having a thickness of at least about 1/32 inch.

5. The railroad car or container of claim 4 wherein the heat conducting metal panel has a thermal conductivity equal to or greater than iron.

6. The railroad car or container of claim 5 wherein the metal is selected from the group consisting of iron, copper, aluminum, magnesium and alloys therof.

7. The railroad car or container of claim 5 wherein the metal is selected from aluminum and alloys thereof.

8. The railroad car or container of claim 1 wherein the bunker vents communicate to the cargo volume, the cargo volume side and end walls are corrugated to the inside and the floor is also corrugated to the inside, an exhaust vent is positioned in communication with the corrugations, the corrugations being connected so if the exhaust vent is open, carbon dioxide vapor can flow from the bunker downward through said wall corrugations around the cargo as well as passing under the cargo before passing through the exhaust vent to the atmosphere.

9. The railroad car or container of claim 8 wherein the car floor includes means to retain for later use of the cooling effect of the carbon dioxide vapor passing through said floor.

10. The railroad car or container of claim 1 wherein a second manifold pipe is included which injects carbon dioxide snow and vapor through the bunker vents into the cargo area, whereby said car may be precooled before loading with cargo or said cargo volume rapidly recooled enroute if said bunker became empty of snow.

11. In an insulated railcar or container having side walls, end walls, a floor, and an exhaust vent for maintaining cargo in a refrigerated condition by the use of carbon dioxide as an expendable refrigerant, wherein liquid or slush carbon dioxide is injected into a carbon dioxide bunker forming snow which remains in said bunker and car and vapor which exists said bunker through a vent(s) into a cargo compartment loaded with cargo, said cargo being arranged so that an open space is formed between said cargo and the bottom of said bunker and said vents, and then by said cargo and under said cargo to an exhaust vent to the outside wherein the improvement comprises a heat conducting material in thermal communication with said snow, one or more convectors in thermal communication with said heat conducting material, the thermal convector(s) being located near the side and or end walls of the railcar or container, a layer of insulation positioned in a bottom area of the bunker between the heat conducting material and the cargo volume free of vents and convectors thereby reducing the cooling by sublimation of said snow to said cargo directly below the snow.

12. The railcar or container of claim 11 wherein the improvement further comprises one or more adjustable dampers cooperating with said convectors to control the amount of cooling provided.

13. The railcar of container of claim 11 wherein open to the interior channel like corrugations in the end and side walls and in the car floor communicate in a manner so that carbon dioxide vapor, created during filling of the bunker with snow, passes through said end and side walls and said floor and through said exhaust vent to the outside; and carbon dioxide vapor created during the sublimation of the snow and the carbon dioxide cooled or that to be cooled by the convectors can circulate down and up said side and end wall channels to maintain the cargo at a uniformly low temperature.

14. In an insulated railcar or container, each having a pair of opposed side walls, and a pair of opposed end walls, for maintaining cargo in a near 0° F. or lower temperature condition by use of solid carbon dioxide as an expendable refrigerant wherein liquid carbon dioxide is injected into a bunker located above a cargo compartment, creating vapor and solid phase (snow) carbon dioxide, the vapor created during such injection cooling portion of both the cargo and the cargo compartment prior to vent to the atmosphere, and said carbon dioxide subsequently cooling said cargo compartment, wherein the improvement comprises heat conducting material in thermal communication with said snow, convectors located near to the side and or end walls of the railcar or container, the convectors being in thermal communication with the heat conducting material, and a layer of insulation in a bottom area of the bunker between the heat conducting material and the cargo volume free of vents and convectors thereby reducing the cooling by sublimation of said snow to said cargo in the near 0° F. or lower temperature condition positioned directly below the snow.

15. The railcar or insulated container of claim 14 wherein the improvement further comprises adjustable dampers cooperating with said convectors to control the amount of cooling provided.

16. In an insulated railroad car or other cargo container for maintaining cargo in a near 0° F. or lower condition by the use of carbon dioxide as an expendable refrigerant, the car or container having a top, a pair of opposed side walls, and a bunker having an insulated floor and vents for carbon dioxide vapor, the bunker positioned beneath the top and above a cargo volume, a manifold pipe positioned so as to provide a supply of carbon dioxide snow on the floor of the bunker, the bunker floor providing at least in part, a ceiling for the cargo volume, the improvement comprising said bunker vents positioned so that at least an opening in one vent communicates with a lower portion of the bunker and at least an opening in another vent communicates with a portion of the bunker above the lower portion of the bunker, whereby circulation of carbon dioxide vapor between said cargo volume and said bunker is enhanced because of height differences in positioning of the openings of the bunker vents and the cargo is maintained in a uniformly refrigerated state.

17. The railroad car or container of claim 16 wherein at least a majority of the bunker vents communicating with the lower portion of the bunker are located near to the side walls.

18. The railroad car or container of claim 17 wherein adjustable dampers are provided at least in part covering the vent(s) communicating with the cargo volume when it is anticipated that such more or less cooling is advantageous.

19. The railroad car or container of claim 16 wherein the bunker is proportioned into sections by a divider(s) extending from at least near one opposed sidewall to the other and extending from the bunker floor to at least near the top of the car to prevent carbon dioxide vapor flow from one section to the other to prevent the majority of carbon dioxide vapor from flowing down a lower vent at one end or one side of the car or container when the car or container is not level.

20. The railroad car or container of claim 16 wherein at least one of the lower bunker vent(s) is combined with a convector.

21. The railroad car or container of claim 16 having a floor at a bottom surface of the car or container, an openable exit vent positioned at or below floor level so that when liquid carbon dioxide is supplied to the bunker through the manifold pipe with the exit vent open and the railroad car loaded with cargo, the carbon dioxide vapor formed during the supply process will pass around and under the cargo before reaching the exit vent.

22. The railroad car or container of claim 20 wherein extended surfaces are part of the convectors so that greater cooling of the carbon dioxide in the cargo volume is provided.

23. The railroad car or container of claim 20 wherein the heat conducting material is in the form of a metal panel having a thickness of at least 1/16 inch.

24. The railroad car or container of claim 23 wherein the metal is selected from a group consisting of iron, copper, aluminum, magnesium and alloys thereof.

25. The railroad car or container of claim 16 wherein the car floor includes means to retain for later use the cooling effects of the carbon dioxide vapor passing through said floor.

26. The railroad car or container of claim 16 wherein a second manifold pipe is included which injects carbon dioxide snow and vapor into the cargo area and a vent which is in communication with the second manifold pipe, whereby said car may be pre-cooled before loading or said cargo volume rapidly re-cooled enroute if said bunker became empty of snow.

27. The railroad car of claim 21 wherein the corrugations are connected so when the exhaust vent is open, the carbon dioxide vapor will pass around the cargo as well as passing under the cargo.

28. The method of maintaining cargo in a near 0° F. or lower condition in an insulated railcar or container by use of carbon dioxide as an expendable refrigerant, wherein liquid or slush carbon dioxide is injected into a carbon dioxide bunker forming snow which remains in said bunker and vapor which exits said bunker through a vent(s) into a cargo compartment loaded with cargo, said cargo being arranged so that an open space is formed between said cargo and the bottom of said bunker and said vents and then said vapor passes by said cargo and under said cargo to an exhaust vent to the outside and said snow subsequently providing controlled uniform cooling from its sublimation to said cargo area substantially by controlling the quantity and direction of flow of the vapor from the cargo compartment rising into said bunker where it is cooled by contact with the snow and controlling the quantity and direction of flow of the vapor in the return of the cooled vapor uniformly to said cargo compartment through the vents.

29. The method of claim 28 wherein said vents control the amount of cooling provided by using adjustable dampers cooperating therewith.

30. The method of claim 28 wherein open to the interior channel like corrugations in the end and side walls and in the car floor communicate in a manner so that carbon dioxide vapor, created during filling the bunker with snow, passes through said end and side walls and said floor; and carbon dioxide vapor created during the sublimation of the snow and the carbon dioxide vapor cooled or that to be cooled by the heat conducting material may circulate down and up said side and end wall channels.

31. The method of claim 28 wherein said vents are located near to the side and or side and end walls.

32. The method of claim 28 wherein one or more convector(s) is utilized in combination with said vents and with a layer of insulation in the bunker floor, leaving the convectors exposed.

* * * * *